US008291980B2

(12) United States Patent
Fay

(10) Patent No.: US 8,291,980 B2
(45) Date of Patent: Oct. 23, 2012

(54) TUBULAR VALVING SYSTEM AND METHOD

(75) Inventor: Peter J. Fay, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 271 days.

(21) Appl. No.: 12/540,868

(22) Filed: Aug. 13, 2009

(65) Prior Publication Data

US 2011/0036592 A1 Feb. 17, 2011

(51) Int. Cl.
*E21B 33/00* (2006.01)

(52) U.S. Cl. ..... 166/317; 166/313; 166/376

(58) Field of Classification Search ..... 166/374, 166/318, 332.3, 373, 383, 153
See application file for complete search history.

(56) References Cited

U.S. PATENT DOCUMENTS

| | | | |
|---|---|---|---|
| 1,883,071 | A | 12/1928 | Stone |
| 2,769,454 | A | 11/1956 | Bletcher et al. |
| 2,812,717 | A | 11/1957 | Brown |
| 2,822,757 | A | 2/1958 | Colberly |
| 2,973,006 | A | 2/1961 | Nelson |
| 3,007,527 | A | 11/1961 | Nelson |
| 3,013,612 | A | 12/1961 | Angel |
| 3,148,731 | A | 9/1964 | Holden |
| 3,211,232 | A | 10/1965 | Grimmer |
| 3,263,752 | A | 8/1966 | Conrad |
| 3,358,771 | A | 12/1967 | Berryman |
| 3,510,103 | A | 5/1970 | Carsello |
| 3,566,964 | A | 3/1971 | Livingston |
| 3,667,505 | A | 6/1972 | Radig |
| 3,703,104 | A | 11/1972 | Tamplen |
| 3,727,635 | A | 4/1973 | Todd |
| 3,797,255 | A | 3/1974 | Kammerer, Jr. et al. |
| 3,901,315 | A | 8/1975 | Parker et al. |
| 3,954,138 | A | 5/1976 | Miffre |
| 3,997,003 | A | 12/1976 | Adkins |
| 4,067,358 | A | 1/1978 | Streich |

(Continued)

FOREIGN PATENT DOCUMENTS

EP 0427422 A2 5/1991

(Continued)

OTHER PUBLICATIONS

Notification of Transmittal of the International Search Report and the Written Opinion of the International Searching Authority; PCT/US2010/044856; Mailed Apr. 15, 2011.

(Continued)

*Primary Examiner* — William P Neuder
*Assistant Examiner* — Yong-Suk Ro
(74) *Attorney, Agent, or Firm* — Cantor Colburn LLP

(57) ABSTRACT

A tubular valving system includes a tubular having a plurality of ports. A plurality of sleeves are disposed at the tubular covering the plurality of ports, and a plug runnable within the tubular is seatingly engagable with the plurality of sleeves such that attainment of a first pressure applied against the plug and one of the plurality of sleeves causes movement of the one of the plurality of sleeves to thereby uncover at least one of the plurality of ports covered by the one of the plurality of sleeves. At least one of the plurality of sleeves is yieldable to allow passage of the plug upon attainment of a second pressure applied thereagainst, and a plurality of occlusive members occlude the plurality of uncovered ports until a later time.

15 Claims, 3 Drawing Sheets

U.S. PATENT DOCUMENTS 4,160,478 A 7/1979 Calhoun et al.
4,176,717 A 12/1979 Hix
4,190,239 A 2/1980 Schwankhart
4,246,968 A 1/1981 Jessup et al.
4,260,017 A 4/1981 Nelson et al.
4,291,722 A 9/1981 Churchman
4,292,988 A 10/1981 Montgomery
4,355,685 A 10/1982 Beck
4,390,065 A 6/1983 Richardson
4,448,216 A 5/1984 Speegle et al.
4,478,279 A 10/1984 Puntar et al.
4,537,383 A 8/1985 Fredd
4,554,981 A 11/1985 Davies
4,566,541 A 1/1986 Moussy et al.
4,576,234 A 3/1986 Upchurch
4,583,593 A 4/1986 Zunkel et al.
4,669,538 A 6/1987 Szarka
4,711,326 A 12/1987 Baugh et al.
4,714,116 A 12/1987 Brunner
4,729,432 A 3/1988 Helms
4,823,882 A 4/1989 Stokley et al.
4,826,135 A 5/1989 Mielke
1,856,591 A 8/1989 Donovan et al.
4,856,591 A 8/1989 Donovan et al.
4,893,678 A 1/1990 Stokley et al.
4,944,379 A 7/1990 Haaser
4,979,561 A 12/1990 Szarka
5,029,643 A 7/1991 Winslow et al.
5,056,599 A 10/1991 Comeaux et al.
5,230,390 A 7/1993 Zastresek et al.
5,244,044 A 9/1993 Henderson
5,297,580 A 3/1994 Thurman
5,305,837 A 4/1994 Johns et al.
5,335,727 A 8/1994 Cornette et al.
5,343,946 A 9/1994 Morrill
5,425,424 A 6/1995 Reinhardt et al.
5,529,126 A 6/1996 Edwards
5,609,178 A 3/1997 Hennig et al.
5,704,393 A 1/1998 Connell et al.
5,762,142 A 6/1998 Connell et al.
5,775,421 A 7/1998 Duhon et al.
5,775,428 A 7/1998 Davis et al.
5,813,483 A 9/1998 Latham et al.
5,960,881 A 10/1999 Allamon et al.
6,050,340 A 4/2000 Scott
6,053,250 A 4/2000 Echols
6,079,496 A 6/2000 Hirth
6,102,060 A 8/2000 Howlett et al.
6,155,350 A 12/2000 Melenyzer
6,173,795 B1 1/2001 McGarian et al.
6,220,350 B1 4/2001 Brothers et al.
6,227,298 B1 5/2001 Patel
6,253,861 B1 7/2001 Carmichael et al.
6,293,517 B1 9/2001 Cunningham
6,378,609 B1 4/2002 Oneal et al.
6,474,412 B2 11/2002 Hamilton et al.
6,530,574 B1 3/2003 Bailey et al.
6,547,007 B2 4/2003 Szarka et al.
6,634,428 B2 10/2003 Krauss et al.
6,644,412 B2 11/2003 Bode et al.
6,666,273 B2 12/2003 Laurel
6,668,933 B2 12/2003 Kent
6,681,860 B1 1/2004 Yokley et al.
6,712,145 B2 3/2004 Allamon
6,712,415 B1 3/2004 Darbishire et al.
6,834,726 B2 12/2004 Giroux et al.
6,866,100 B2 3/2005 Gudmestad et al.
6,896,049 B2 5/2005 Moyes
6,948,561 B2 9/2005 Myron et al.
6,983,795 B2 1/2006 Zuklic et al.
7,150,326 B2 12/2006 Bishop et al.
7,322,408 B2 1/2008 Howlett
7,325,617 B2 2/2008 Murray
7,337,847 B2 3/2008 McGarian et al.
7,350,578 B2 4/2008 Szarka et al.
7,377,321 B2 5/2008 Rytlewski
7,387,165 B2 6/2008 Lopez de Cardenas et al.
7,416,029 B2 8/2008 Telfer et al.
7,467,664 B2 12/2008 Cochran et al.
7,503,390 B2 3/2009 Gomez
7,503,392 B2 3/2009 King et al.
7,520,336 B2 4/2009 Mondelli et al.
7,730,953 B2 6/2010 Casciaro
7,832,472 B2 11/2010 Themig
2001/0007284 A1 7/2001 French et al.
2004/0007365 A1 1/2004 Hill et al.
2005/0061372 A1 3/2005 McGrath et al.
2005/0072572 A1 4/2005 Churchill
2005/0126638 A1 6/2005 Gilbert
2005/0205264 A1 9/2005 Starr et al.
2006/0124310 A1 6/2006 Lopez De Cardenas et al.
2006/0169463 A1 8/2006 Howlett
2006/0175092 A1 8/2006 Mashburn
2006/0213670 A1 9/2006 Bishop et al.
2006/0243455 A1 11/2006 Telfer et al.
2007/0007007 A1 1/2007 Themig et al.
2007/0012438 A1 1/2007 Hassel-Sorensen
2007/0023087 A1 2/2007 Krebs et al.
2007/0095538 A1 5/2007 Szarka et al.
2007/0272413 A1 11/2007 Rytlewski et al.
2008/0066924 A1 3/2008 Xu
2008/0093080 A1 4/2008 Palmer et al.
2008/0190620 A1 8/2008 Posevina et al.
2008/0217025 A1 9/2008 Ruddock et al.
2008/0308282 A1 12/2008 Standridge et al.
2009/0032255 A1* 2/2009 Surjaatmadja et al. ..... 166/281
2009/0044946 A1 2/2009 Schasteen et al.
2009/0044955 A1 2/2009 King et al.
2009/0056934 A1 3/2009 Xu
2009/0056952 A1 3/2009 Churchill
2009/0107680 A1 4/2009 Surjaatmadja
2009/0159289 A1 6/2009 Avant et al.
2009/0308588 A1 12/2009 Howell et al.
2010/0294514 A1 11/2010 Crow et al.
2011/0108284 A1 5/2011 Flores et al.
2011/0180274 A1 7/2011 Wang et al.

FOREIGN PATENT DOCUMENTS

GB 2281924 3/1995
WO 00/15943 3/2000

OTHER PUBLICATIONS

Notification of Transmittal of the International Search Report and the Written Opinion of the International Searching Authority; PCT/US2010/044383; Mailed Apr. 15, 2011.

International Search Report; PCT/US2010/044399; International Searching Authority KIPO; Mailed Mar. 21, 2011.

Notification of Transmittal of the International Search Report and the Written Opinion of the International Searching Authority; PCT/US2010/054487; International Searching Authority; KIPO; Mailed Jun. 3, 2011.

Notification of Transmittal of the International Search Report and the Written Opinion of the International Searching Authority; PCT/US2010/049810; International Searching Authority KIPO; Mailed Apr. 25, 2011.

International Search Report and Written Opinion; Date of Mailing Aug. 29, 2011; International Application No. PCT/US2011/022523; International Filing Date Jan. 26, 2011; Korean Intellectual Property Office; International Search Report 5 pages; Written Opinion 3 pages.

Response to Office Action dated Oct. 15, 2008, in U.S. Appl. No. 11/891,713, U.S. Patent and Trademark Office, U.S.A.

Office Action dated Jun. 25, 2009, in U.S. Appl. No. 11/891,714, USPTO, U.S.A.

Office Action dated Jun. 19, 2009, in U.S. Appl. No. 11/891,715, U.S. Patent and Trademark Office, U.S.A.

Response to Restriction Requirement dated Apr. 22, 2009 in U.S. Appl. No. 11/891,715, U.S. Patent and Trademark Office, U.S.A.

Office Action dated Apr. 9, 2009, in U.S. Appl. No. 11/891,715, U.S. Patent and Trademark Office, U.S.A.

Notice of Allowance & Fees Due and Notice of Allowability dated Jan. 5, 2009, in U.S. Appl. No. 11/891,713, U.S. Patent and Trademark Office, U.S.A.

Office Action dated Jul. 16, 2008 in U.S. Appl. No. 11/891,713 U.S. Patent and Trademark Office, U.S.A.
International Search Report, Feb. 11, 2009 pp. 1-3, PCT/US2008/072732, Korean Intellectual Property Office.
Notification of Transmittal of the International Search Report and the Written Opinion of the International Searching Authority, or the Declaration, Feb. 11, 2009, pp. 1-4, PCT/US2008/072732, Korean Intellectual Property Office.
Notification of Transmittal of the International Search Report and the Written Opinion of the International Searching Authority, or the Declaration, Feb. 11, 2009, pp. 1-4, PCT/US2008/072734, Korean Intellectual Property Office.
Written Opinion of the International Searching Authority, Feb. 11, 2009, pp. 1-3, PCT/US2008/072732, Korean Intellectual Property Office.
Written Opinion of the International Searching Authority, Feb. 11, 2009, pp. 1-4, PCT/US2008/072734, Korean Intellectual Property Office.
International Search Report, Feb. 11, 2009, pp. 1-3, PCT/US2008/072734, Korean Intellectual Property Office.
International Search Report, Feb. 11, 2009, pp. 1-3, PCT/US2008/072735, Korean Intellectual Property Office.
Notification of Transmittal of the International Search Report and the Written Opinion of the International Searching Authority, or the Declaration, Feb. 11, 2009, pp. 1-4, PCT/US2008/072735, Korean Intellectual Property Office.
Notification of Transmittal of the International Search Report and the Written Opinion of the International Searching Authority, or the Declaration, Jan. 19, 2009, pp. 1-4, PCT/US2008/072470, Korean Intellectual Property Office.
Written Opinion of the International Searching Authority, Feb. 11, 2009, pp. 1-4, PCT/US2008/072735, Korean Intellectual Property Office.
Written Opinion of the International Searching Authority, Jan. 19, 2009, pp. 1-3, PCT/US2008/072470, Korean Intellectual Property Office.
International Search Report, Jan. 19, 2009, pp. 1-3, PCT/US2008/072470, Korean Intellectual Property Office.
Baker Hughes, Baker Oil Tools, Conventional Fishing Technical Unit; Pump Out Sub Product Family No. H14061, Jun. 7, 2005, 1 page.
Ross, C. M., et al., "Current Materials and Devices for Control of Fluid Loss," SPE 54323, Apr. 1999, pp. 1-16.
Hoffman, C.R., "One-Trip Sand-Control/Liner Hangar/ Big-Bore Completion System," SPE 101086, Sep. 2006, pp. 1-10.
G.L. Rytlewski, A Study of Fracture Initiation Pressures in Cemented Cased-Hole Wells Without Perforations, May 15, 2006, pp. 1-10, SPE 100572, Society of Petroleum Engineers, U.S.A.
Boscan, J. et al., "Successful Well Testing Operations in High-Pressure/High-Temperature Encironment; Case Histories," SPE 84096, Oct. 2003, pp. 1-15.
Brad Musgrove, Multi-Layer Fracturing Solution Treat and Produce Completions, Nov. 12, 2007, pp. 1-23, Schlumberger, U.S.A.
RFID Keystone Module, RFID & Intelligent Products, Petrowell retrieved online on May 27, 2009 from: http://www.petrowell.co.uk/index2.php?option=com_docman&task=doc_view&gid=15&Itemid=26.
StageFRAC Maximize Reservoir Drainage, 2007, pp. 1-2, Schlumberger, U.S.A.
TAP Completion System, Schlumberger, 4 pages, Dec. 2007.
International Search Report and Written Opinion of the International Searching Authority; PCT/US2010/044378; Mailed Mar. 17, 2011.
International Search Report; PCT/US2010/033737; Korean Intellectual Property Office; Mailed Jan. 24, 2011.
International Search Report; Date of Mailing Jan. 24, 2011; International Appln No. PCT/US2010/034736; 3 Pages.
International Search Report; Date of Mailing Jan. 24, 2011; Internatiaonal Appln. No. PCT/US2010/034735; 3 Pages.
Nternational Search Report and Written Opinion; Date of Mailing Feb. 11, 2011; International Appln No. PCT/US2010/041049; International Search Report 5 Pages and Written Opinion 3 Pages.
Notification of Transmittal of the International Search Report and the Written Opinion of the International Searching Authority; PCT/US2011/041663; Korean Intellectual Property Office; Mailed Dec. 14, 2011; 8 pages.

* cited by examiner

TUBULAR VALVING SYSTEM AND METHOD

BACKGROUND

Tubular valves that control occlusion of ports that fluidically connect an inner bore of a tubular with an outside of the tubular are commonly used in several industries including the downhole completion industry. Such valves are deployed in boreholes to control fluid flow in both directions, inside to outside of the tubular as well as outside to inside of the tubular, through ports. New systems and methods that improve control over the opening of such ports along a tubular are always of interest to operators of such systems.

BRIEF DESCRIPTION

A tubular valving system comprising a tubular having a plurality of ports; a plurality of sleeves disposed at the tubular covering the plurality of ports; a plug runnable within the tubular and seatingly engagable with the plurality of sleeves such that attainment of a first pressure applied against the plug and one of the plurality of sleeves causes movement of the one of the plurality of sleeves to thereby uncover at least one of the plurality of ports covered by the one of the plurality of sleeves; at least one of the plurality of sleeves being yieldable to allow passage of the plug upon attainment of a second pressure applied thereagainst; and a plurality of occlusive members occluding the plurality of uncovered ports until a later time.

A method of valving a plurality of ports in a tubular comprising running a plug within the tubular; sequentially seatingly engaging the plug with a plurality of sleeves covering a plurality of ports in the tubular; pressuring up against the plug to a first pressure; moving the plurality of sleeves; uncovering the plurality of ports; pressuring up against the plug to a second pressure; yieldably defeating at least one of a plurality of seats disposed at the plurality of sleeves; and removing a plurality of occlusive members from the plurality of ports that are uncovered.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
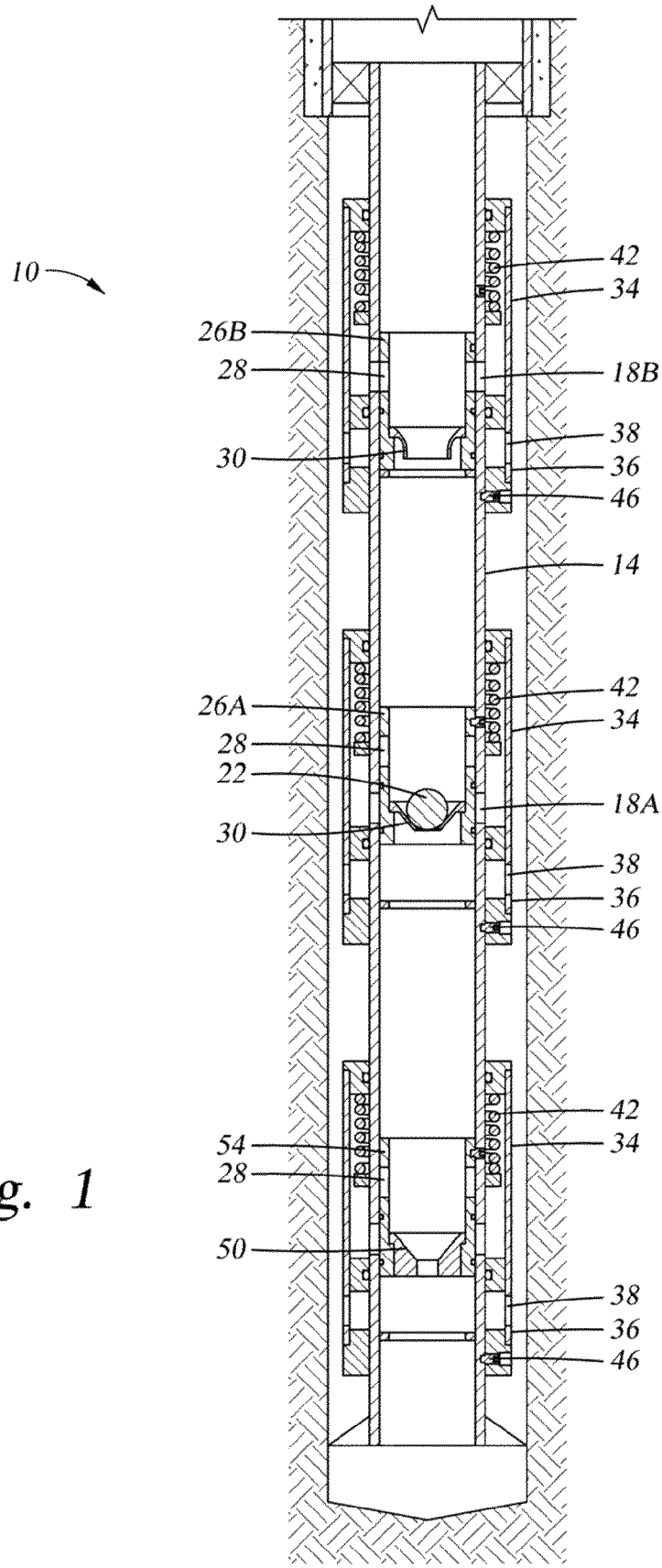
FIG. 1 depicts a schematical sectional view of a tubular valving system disclosed herein.
Figure 2:
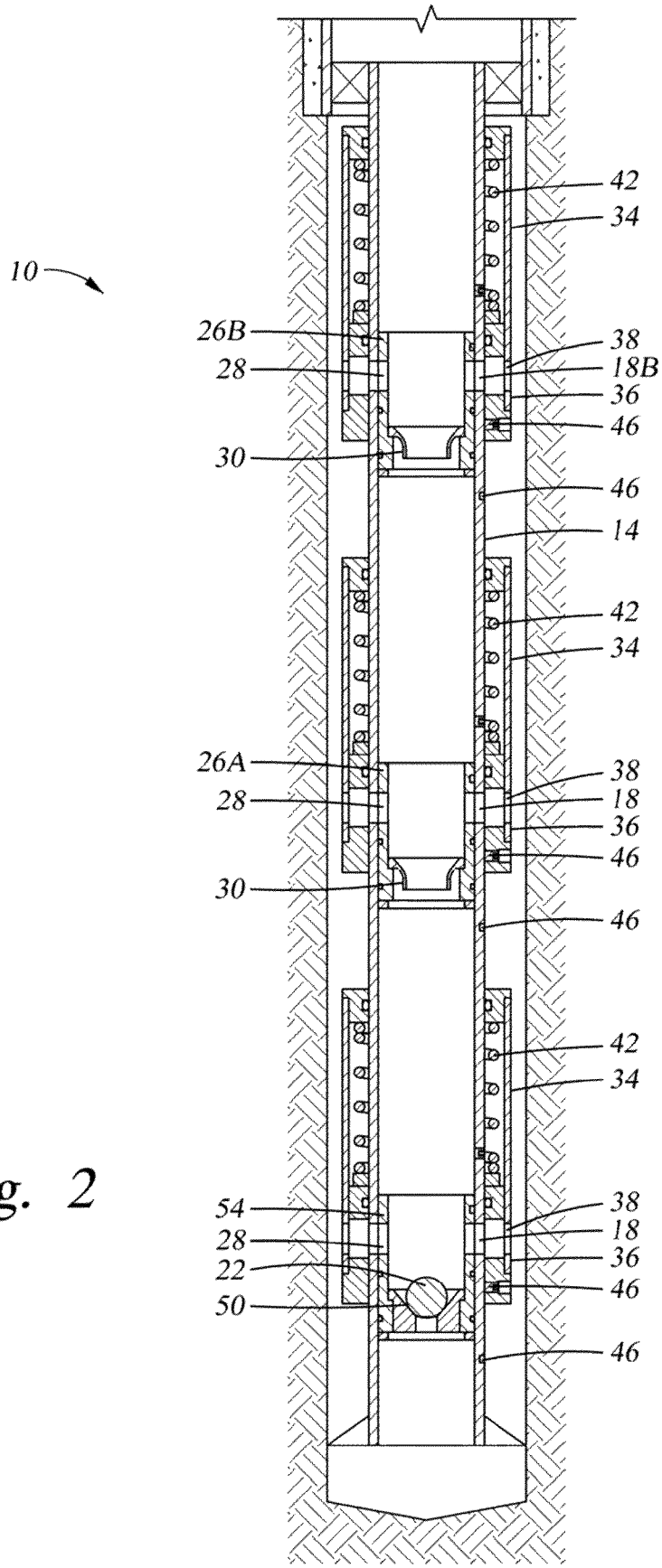
FIG. 2 depicts a schematical sectional view of the tubular valving system of FIG. 1, shown in an alternate position.

Referring to FIGS. 1 and 2, an embodiment of a tubular valving system is illustrated generally at 10. The valving system 10 includes, a tubular 14 having a plurality of ports 18, a plug 22, disclosed herein as a ball, runnable within the tubular 14, and a plurality of sleeves 26 seatingly receptive to the plug 22. Each of the sleeves 26 is slidably sealingly engaged with the tubular 14 such that the sleeves 26 cover one or more of the ports 18A when in a first position as illustrated by the sleeve 26A while the sleeves 26 uncover the ports 18B when in a second position as illustrated by the sleeve 26B by longitudinal alignment of openings 28 in the sleeve 26B with the ports 18B. The sleeves 26 have a yieldable seat 30, illustrated herein as a ball seat that is sealingly engagable with one of the plugs 22 run thereagainst. At selected pressures applied across the seated plug 22 the sleeve 26 is urged to move relative to the tubular 14. As such, the sleeve 26 is movable from the first position to the second position, for example, to uncover the ports 18 covered thereby. When pressure is increased beyond a selected threshold pressure the yieldable seat 30 yields permitting the plug 22 to pass thereby and travel to another of the sleeves 26. By setting the pressure needed to yield the yieldable seat 30 to a greater value than the pressure needed to move the sleeve 26, the sleeve 26 is sure to move prior to yielding of the yieldable seat 30. Occlusive members 34 occlude the ports 18 until sometime after the sleeves 26 have become uncovered as will be discussed below.

The occlusive members 34 disclosed in this embodiment include collars 36 that are slidably sealingly engaged with the tubular 14 such that the ports 18 are occluded when the collars 36 are in a first position as illustrated by the collars 36 in FIG. 1 and the ports 18 are not occluded, or removed, when the collars 36 are in a second position as illustrated in FIG. 2, wherein openings 38 in the collars 36 are aligned with the ports 18.

The collars 36 of the occlusive members 34 in this embodiment are moved from the first position to the second position in response to a drop in pressure within the tubular 14 that allows biasing members 42, illustrated herein as compression springs, to move the collars 36 to the second position. Release members 46, shown in this embodiment as shear screws that longitudinally fix the collars 36 to the tubular 14 until after the release members 46 have been released, prevent movement of the collars 36 to the second position. Release of the release members 46 is accomplished by increasing pressure within the tubular 14 that acts on differential areas on the collars 36 to urge the collars 36 in a longitudinal direction opposite to the direction that aligns the openings 38 with the ports 18. By setting this releasing pressure of the release members 46 to a greater value than the pressure needed to yield the yieldable seats 30, the yieldable seats 30 are sure to yield prior to release of the release members 46. Once the release members 46 have been released the biasing members 42 are configured to move the collars 36 from the first position to the second position upon a drop in pressure below a selected threshold pressure. The collars 36 disclosed herein are similar to a device disclosed in U.S. Pat. No. 7,503,390 to Gomez, which is incorporated herein in its entirety by reference.

Increasing pressure within the tubular 14 to a pressure able to cause release of the release members 46 may be achieved against the plug 22 seated on a non-yieldable seat 50 that may be located on a slidable sleeve 54, as illustrated, or on a seat (not shown) longitudinally fixed to the tubular 14 depending upon the needs of each specific application.

Figure 3:
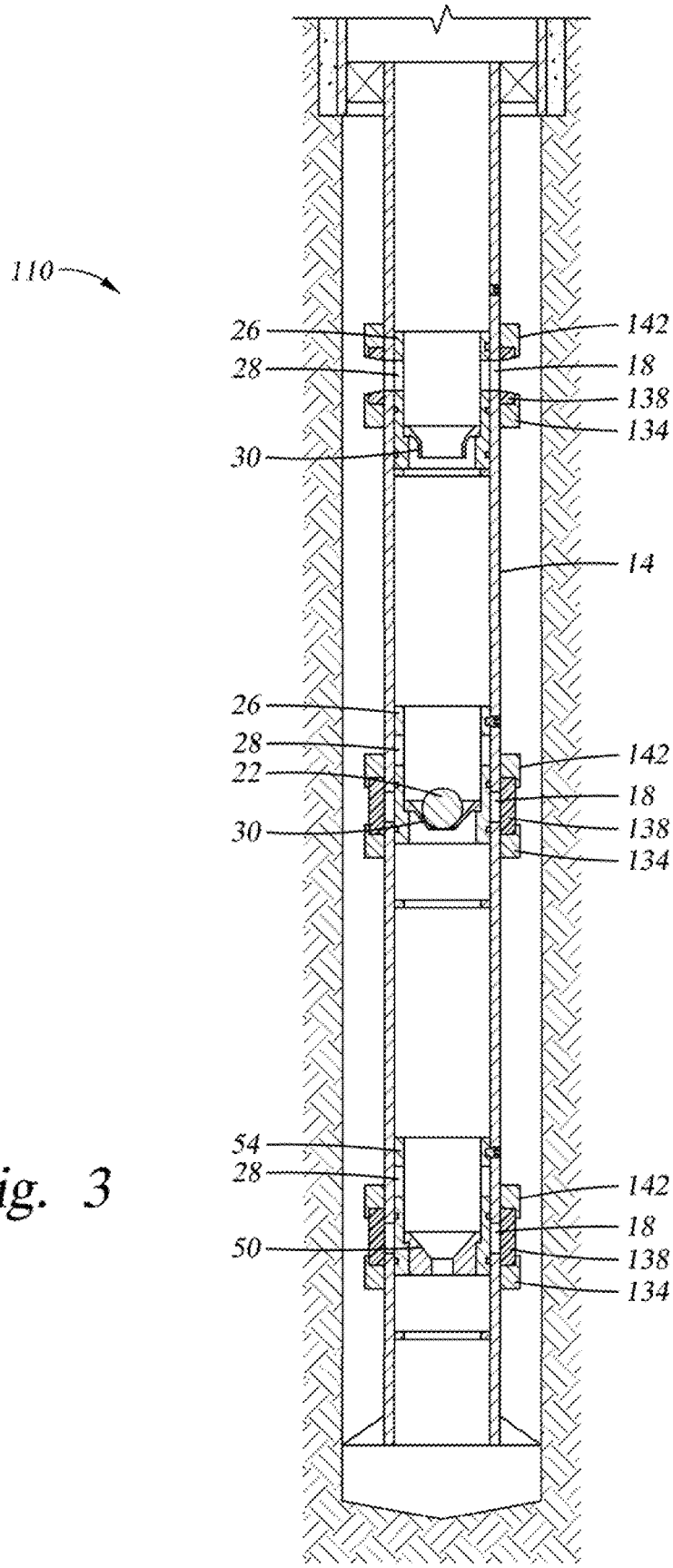
FIG. 3 depicts a schematical sectional view of an alternate embodiment of a tubular valving system disclosed herein.

Referring to FIG. 3, an alternate embodiment of a tubular valving system is illustrated generally at 110. The system 110 includes several of the same elements of the system 10 and as such like elements are numbered alike and in the interest of brevity are not described again in detail hereunder. A primary difference between the system 110 and the system 10 is that occlusive members 134 in the system 110 replace the occlusive members 34 in the system 10. The occlusive members 134 include dissolvable material 138 that occludes the ports 18, yet removes the occlusion once dissolved. Optional collars 142 that are sealedly attached to the tubular 14 can structurally support the dissolvable material 138. The dissolvable material 138 is substantially isolated from conditions within the tubular 14 that can promote dissolving of the dissolvable material 138, such as chemicals, fluids and pressure, for example, by the sleeves 26 when the sleeves 26 are in the first position. Such conditions can be conditions anticipated to be encountered downhole in a wellbore. Movement of the sleeves 26 to the second position exposes the dissolvable material 138 to conditions within the tubular 14 thereby initiating dissolving of the dissolvable material 138.

Since increases in pressure are used to move the sleeves 26, it may be desirable to limit any leak paths from the tubular 14 until all of the sleeves 26 have been moved. Delays in dissolving the dissolvable materials 138, and subsequent removal of occlusion of the ports 18 thereby may be desirable. Such delays could be controlled by a rate of dissolving as estimated by selected physical and chemical properties of the dissolvable material 138 once exposed to the conditions within the tubular 14. Alternately, the conditions within the tubular 14 may be controlled by an operator such that dissolving of the dissolvable material 138 is not initiated until an operator alters the conditions within the tubular 14 thereby exposing the dissolvable material 138 thereto such as by pumping specific chemicals within the tubular 14.

Alternate embodiments can have a plurality of the tubular valving systems 10, 110 distributed along the tubular with the systems 10, 110 located further from surface having seats 30 receptive to larger plugs 22 than systems 10 nearer to the surface. In such embodiments the occlusive members 34, 134 are isolated from the conditions within the tubular 14 that results in removal of the occlusion of the ports 18 until after the sleeves 26 that cover the ports 18 have been moved to the second position.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A tubular valving system, comprising:

a tubular having a plurality of ports;

a plurality of sleeves disposed at the tubular covering the plurality of ports;

a plug runnable within the tubular being seatingly engagable with each of the plurality of sleeves such that attainment of a first pressure applied against the plug and a first of the plurality of sleeves causes movement of the first of the plurality of sleeves to thereby uncover at least one of the plurality of ports covered by the first of the plurality of sleeves, the first of the plurality of sleeves being yieldable to allow passage of the plug upon attainment of a second pressure applied thereagainst to allow the plug to move to be seatingly engagable with a second of the plurality of sleeves such that the second of the plurality of sleeves is movable in response to a third pressure being applied against the plug to uncover at least an additional one of the plurality of ports, the second of the plurality of sleeves being yieldable to allow passage of the plug upon attainment of a fourth pressure while seated thereagainst, the foregoing sequence being repeatable against a selected number of the plurality of sleeves; and occlusive members positioned and configured to occlude the plurality of ports while the plurality of ports are uncovered by the plurality of sleeves until a later time.

2. The tubular valving system of claim 1, wherein the occlusive members allow subsequent pressure build-up cycles to occur to move some of the plurality of sleeves and to yieldably pass the plug past some of the plurality of sleeves and prevent fluid from escaping through any of the plurality of the ports that have been uncovered until the later time when the occlusive members uncover the plurality of ports they are occluding.

3. The tubular valving system of claim 1, wherein the plurality of occlusive members are dissolvable.

4. The tubular valving system of claim 3, wherein the plurality of occlusive members dissolve after a selectable amount of time after exposure to specific conditions.

5. The tubular valving system of claim 4, wherein the specific conditions are anticipated to be encountered downhole.

6. The tubular valving system of claim 4, wherein the specific conditions include a chemical that is pumpable within the tubular.

7. The tubular valving system of claim 1, wherein at least one of the first pressure is equal to the third pressure and the second pressure is equal to the fourth pressure.

8. A method of valving a plurality of ports in a tubular, comprising:

running a plug within the tubular;

seatingly engaging the plug with a first of a plurality of sleeves covering a plurality of ports in the tubular;

pressuring up against the plug while the plug is seated with the first of the plurality of sleeves to a first pressure;

moving the first of the plurality of sleeves;

uncovering at least one of the plurality of ports with the moving of the first of the plurality of sleeves;

pressuring up against the plug while seated at the first of the plurality of sleeves to a second pressure;

yieldably defeating seat disposed at the first of the plurality of sleeves;

seatingly engaging the plug with a second of the plurality of sleeves covering the plurality of ports in the tubular;

pressuring up against the plug while the plug is seated with the second of the plurality of sleeves to a third pressure;

moving the second of the plurality of sleeves;

uncovering at least one of the plurality of ports with the moving of the second of the plurality of sleeves;

pressuring up against the plug while seated at the second of the plurality of sleeves to a fourth pressure;

yieldably defeating a seat disposed at the second of the plurality of sleeves; and removing an occlusive member from occluding the plurality of ports subsequent being uncovered at a later time.

9. The method of valving a plurality of ports in a tubular of claim 8, further comprising dissolving the occlusive member.

10. The method of valving a plurality of ports in a tubular of claim 8, further comprising exposing the plurality of occlusive members to conditions dissolvable thereof

11. The method of valving a plurality of ports in a tubular of claim 8, wherein the removing the plurality of occlusive members includes moving the plurality of occlusive members relative to the tubular.

12. The method of valving a plurality of ports in a tubular of claim 11, wherein the moving is in response to a drop in pressure.

13. The method of valving a plurality of ports in a tubular of claim 8, further comprising releasing a plurality of release members engaged between the tubular and the plurality of occlusive members.

14. The method of valving a plurality of ports in a tubular of claim 13, wherein the releasing the plurality of release members includes building pressure to a third pressure.

15. The method of valving a plurality of ports in a tubular of claim 14, wherein the third pressure is greater than the second pressure.

* * * * *